US007431083B2

(12) United States Patent
Olsen

(10) Patent No.: US 7,431,083 B2
(45) Date of Patent: Oct. 7, 2008

(54) SUB-SURFACE COALBED METHANE WELL ENHANCEMENT THROUGH RAPID OXIDATION

(75) Inventor: Thomas N. Olsen, Parker, CO (US)

(73) Assignee: Schlumberger Technology Corporation, Sugarland, TX (US)

( * ) Notice: Subject to any disclaimer, the term of this patent is extended or adjusted under 35 U.S.C. 154(b) by 259 days.

(21) Appl. No.: 11/279,593

(22) Filed: Apr. 13, 2006

(65) Prior Publication Data

US 2007/0240880 A1 Oct. 18, 2007

(51) Int. Cl.
*E21B 43/247* (2006.01)
*E21B 43/248* (2006.01)

(52) U.S. Cl. ..... 166/259; 166/297; 166/308.1

(58) Field of Classification Search ..... None
See application file for complete search history.

(56) References Cited

U.S. PATENT DOCUMENTS 3,529,666 A 9/1970 Crowe
3,777,816 A 12/1973 Meier
3,986,906 A 10/1976 Sayles
3,999,607 A * 12/1976 Pennington et al. ..... 166/259
4,057,107 A 11/1977 Pusch et al.
4,867,238 A 9/1989 Bayless et al.
5,034,073 A 7/1991 Barry et al.
5,443,118 A 8/1995 Yannimaras et al.
6,969,123 B2 11/2005 Vinegar et al.
2003/0037692 A1 * 2/2003 Liu ..... 102/301
2005/0051328 A1 3/2005 Wilson
2006/0266551 A1 11/2006 Yang

* cited by examiner

*Primary Examiner*—Zakiya W. Bates
(74) *Attorney, Agent, or Firm*—Thomas O. Mitchell; David Cate; Robin Nava

(57) ABSTRACT

A method of stimulating production of coalbed methane involves providing a perforation charge comprising a standard charge portion and a charge additive able to produce localized temporary oxidizing environments in perforations. A coal-bearing formation is perforated with the perforation charge to form initial perforations defined by carbonaceous material. The initial perforations have localized temporary oxidizing environments in them. Combustion of the carbonaceous material is initiated using the oxidizing environments, thus enlarging the initial perforations. Other methods involve perforating the coal-bearing formation with a standard perforation charge, thereby creating perforations. The perforations are treated with a composition creating temporary local oxidizing environments involving an oxidant in the perforations. Combustion of carbonaceous material is initiated using the excess oxidant, thus enlarging the perforations.

25 Claims, 6 Drawing Sheets

SUB-SURFACE COALBED METHANE WELL ENHANCEMENT THROUGH RAPID OXIDATION

BACKGROUND OF THE INVENTION

1. Field of Invention

The present invention relates generally to the field of coalbed methane production, and more specifically to methods for application of fluids or materials into subsurface coal seams that release free oxygen to create a rapid oxidation reaction within the coal seam in order to stimulate natural gas production from the coal seam.

2. Related Art

Commercial natural gas production from subsurface coal seams has now entered its third decade. Subsurface coal seams may contain a large amount of natural gas or methane (commonly referred to as coalbed methane, or CBM) that is adsorbed onto the surface of the coal. This gas is released from the coal and may be produced when the pressure is significantly reduced in the coal seam. However in most cases the depressurization (and thus the gas production) is curtailed by either low permeability in the coal, or because of damage to the coal during the drilling or completion process.

To date there are two methods of stimulation or bypassing damaged coals to increase the amount of gas production: a) cavitation; or b) hydraulic fracturing. Cavitation is a method of removing coal through repeated injections of fluids and aggressive flowbacks to shear off and produce coal up a wellbore, thus enlarging the wellbore by creating a cavity. Unfortunately this method has been successful only in a very limited amount of coal seams containing coal having specific friable properties.

The other method, hydraulic fracturing, is much the same method that has been applied in conventional oil and gas formations for years. This involves inducing fractures in the coal seams by pumping fluids into the formation at high pressures and at high rates. Unfortunately, due to the soft nature of the coals and to the presence of natural fractures (called cleats), these induced hydraulic fractures have not been very efficient and far underperform similar applications in conventional oil and gas formations. Proppant has been added to the fracturing fluid to enhance the fracture conductivity after the hydraulic pressure is bled off; however premature proppant bridging has been a problem in coal seam fracturing. Often, high viscosity fluids were required to successfully place these proppant treatments. However, these high viscosity fluids often cause secondary damage to the coal cleats adjacent to the fracture, which could greatly temper the stimulation effects of the fracture treatment.

Coal is a subterranean formation composed largely of carbon compounds, for example having a typical composition of about (85% C, 5% H, 5% (O,N,S) 5% M), in which C refers to total carbon content (fixed plus volatile matter); H refers to total hydrogen content; O,N,S refers to the total of oxygen, plus nitrogen, plus sulphur; and M refers to the total content of inert matter. Coal and carbonates (limestones and dolomites) are often sources of oil and gas production and are often naturally fractured, which enhances their potential productivity. Coal, limestones and dolomites may have limited oil and gas productivity due to low permeability or to damage during drilling and completion. However, the carbonates may be stimulated readily or their damage may be bypassed because the rock may be dissolved readily with cost effective acid, such as hydrochloric acid. The limestone/HCl dissolution reaction is:

$$2HCl+CaCO_3 \text{<-->} CaCl_2+H_2O+CO_2$$

The dolomite/HCl dissolution reaction is:

$$4HCl+CaMg(CO_3)_2 \text{<-->} CaCl_2+MgCl_2+2H_2O+2CO_2$$

These formations can be stimulated by enlarging the wellbore and removing or bypassing damage, or hydraulic fractures can be enhanced by fracturing with an acidic fluid which will remove rock along the fracture face and enhance the permeability of the fracture after hydraulic pressure is removed.

Several efforts have been made to use oxidizers for increasing CBM production, however none of these describes or suggests using combustion enhanced by providing an oxidizer for rock removal in stimulation of CBM production. There is a continuing and as yet unmet need for increasing CBM production.

SUMMARY OF THE INVENTION

In accordance with the present invention, methods of increasing production of coalbed methane are described that reduce or overcome problems in previously known methods. The inventive methods allow coal-bearing formations (such as coal seams, and the like) to be stimulated into producing more coalbed methane by providing a temporary oxidizing environment, allowing combustion of coal and increasing the size of hydraulic-induced fractures or perforations. The inventive methods involve the introduction of one or more compositions into subsurface coal seams via drilled wellbores that release and/or generate oxidizing materials in sufficient concentration and quantity to produce temporary, local oxidizing environments to support enhance-rate oxidation of carbonaceous materials. The function of the enhanced rate oxidation reaction is to stimulate the production of natural gas from these coal seams by removing coal in key areas to improve the connectivity and flow paths from the coal seam to the wellbore. This may include removing or bypassing damaged regions of coal-bearing formations adjacent to the wellbore caused by drilling and well completions, from hoop stresses, or combinations of these reasons.

One aspect of the invention is a method of stimulating production of coalbed methane from a coal-bearing formation, including providing a wellbore able to access a coal-bearing formation, providing a perforation charge having a standard charge portion and a composition able to produce localized temporary oxidizing environments including an oxidant in the perforations; perforating the coal-bearing formation with the perforation charge to form initial perforations defined by carbonaceous material, the initial perforations having localized temporary oxidizing environments in them, and initiating combustion of the carbonaceous material in the presence of the oxidizing environments, thus enlarging the initial perforations. Combustion may be initiated simply by heat of friction of a perforating projectile against the coal-bearing formation. Alternatively, or in addition thereto, initiation of combustion may be accomplished by any number of methods discussed herein, such as electrical heating elements, auxiliary combustors, wireline sparking, and the like.

Another method of the invention includes stimulating production of coalbed methane from a coal-bearing formation, by providing a wellbore able to access a coal-bearing formation, perforating the coal-bearing formation with a standard perforation charge, thereby creating perforations; treating the perforations with a composition creating temporary local oxidizing environments comprising an oxidant in the perforations, and initiating combustion of carbonaceous material using the oxidizing environments, thus enlarging the perforations. In this method, if combustion is not initiated by frictional heating, combustion may be initiated or supplemented by the methods described in relation to the first method. Some embodiments may comprise, prior to perforating, pre-packing or spotting the composition comprising an oxidizer in the wellbore. For example, with either cased or uncased well bores, one or more screens may be installed in the flow path between the production tubing and the coal-bearing formation. A packer may be set above and below the screen to seal off the annulus in the producing zone from non-producing formations. To spot the composition comprising the oxidizer around the screen, a work string and service seal unit may be used. The service seal unit may be employed to pump a composition (for example gravel or gel comprising the oxidizer) through the work string where the composition is squeezed between the coal-bearing formation and the screen. The composition may be pumped down the work string in a slurry of water or gel and spotted to fill the annulus between the screen and the well casing or wellbore side wall. In well installations in which the screen is suspended in an uncased open bore, the pre-pack helps support the surrounding formation. In these embodiments, once the composition comprising the oxidizer is spotted, the steps of perforating and treating the perforations may occur at substantially the same time. The perforation charges travel through the composition and may serve to initiate combustion of the oxidizer and coal and/or methane in the formation.

As used herein the term "standard charge" means a charge that would normally serve the function of perforating the casing and the coal-bearing formation. The term "composition" means a compound or composition functioning to provide the stated oxidizing environment. The composition may be gaseous, liquid, solid, and any combination thereof. Examples are provided herein. As used herein the phrase "enlarging the perforations" means to increase the size of any one or more dimension, including average diameter, volume, and/or penetration distance of the perforations. "Perforating" means shooting a projectile through a sidewall of a wellbore using an explosive charge, wherein "wellbore" may be cased, cased and cemented, or open hole, and may be any type of well, including, but not limited to, a producing well, a non-producing well, an experimental well, an exploratory well, and the like. Wellbores may be vertical, horizontal, any angle between vertical and horizontal, diverted or non-diverted, and combinations thereof, for example a vertical well with a non-vertical component. The term "coal-bearing" means coal of any rank. The term "carbonaceous material" includes coal and combustible materials in coal, such as macerals. A maceral is a component of coal. The term is analogous to the term mineral, as applied to igneous or metamorphic rocks. Examples of macerals are inertinite, vitrinite and liptinite. Inertinite is considered to be the equivalent of charcoal and degraded plant material. Vitrinite is considered to be composed of cellular plant material such as roots, bark, plant stems and tree trunks. Vitrinite macerals when observed under the microscope show a boxlike, cellular structure, often with oblong voids and cavities which are likely the remains of plant stems. Liptinite macerals are considered to be produced from decayed leaf matter, spores, pollen and algal matter. Resins and plant waxes can also be part of liptinite macerals. The term "methane" includes natural gas.

A third method of the invention includes:

(a) contacting, through a wellbore, surfaces of fractures of a coal-bearing formation with a composition containing, or that produces upon contact with the surfaces, localized temporary oxidizing environments in the fractures; and (b) combusting carbonaceous material in the oxidizing environment under conditions sufficient to expansively but not explosively oxidize some of the carbonaceous material to enlarge the fractures.

Combusting the carbonaceous material may be initiated by one or more of the techniques discussed in reference to the first two methods. In methods within this aspect of the invention, "fractures" includes both cleats and man-made fractures. Methods within this aspect may be particularly suitable for relieving flow blockages that may be present due to the arch-like tension around a wellbore and in a plane generally perpendicular to the wellbore axis. The composition may be solid, liquid, gas, or any combination thereof, for example slurries. Methods within this aspect of the invention include those wherein the combusting results in the fractures extending deeper into the coal-bearing formation than the original fractures, the fractures having larger effective diameter than the fractures before the treatment, or a combination thereof, and these enlarged fractures may remain open when the well is placed back in production. Optionally, injection of a proppant fracturing fluid, or other fracturing fluid, may be performed after the combusting step. In certain embodiments, the pressure of the wellbore may be suddenly decreased after the combusting step and prior to the injection of a fracturing fluid. These methods reduce or eliminate near wellbore problems that often cause premature termination of propped fracture treatments.

In yet another method, the oxidizer may be a material spotted in the wellbore or squeezed into the coal seam prior to the gun placement and firing. For example, an oxygen source (oxidizing material) may be pumped (or spotted) into the wellbore or into (or across) the coal seam in a first step, and then in a second step the perforating guns or the propellant gun may be used as an ignition source to promote or provide the combustion enhancement. The perforation or stimulation gun may be lowered into the wellbore after the oxidizer is placed, and fired off to create ignition in the coal seam. This method may be applied either in a new (unperforated) wellbore, or as a remedial stimulation treatment in which the oxidative material is squeezed into the coal seam prior to ignition. In a not yet perforated wellbore, the composition may be placed inside the casing adjacent the coal seam, or the composition may be pumped into the annulus between the casing and the coal and then cement may be pumped down the annulus and displace the composition into the bottom of the casing adjacent the coal seam. Methods of the invention will become more apparent upon review of the brief description of the drawings, the detailed description of the invention, and the claims that follow.

BRIEF DESCRIPTION OF THE DRAWINGS

The manner in which the objectives of the invention and other desirable characteristics may be obtained is explained in the following description and attached drawings in which.

Figure 1:
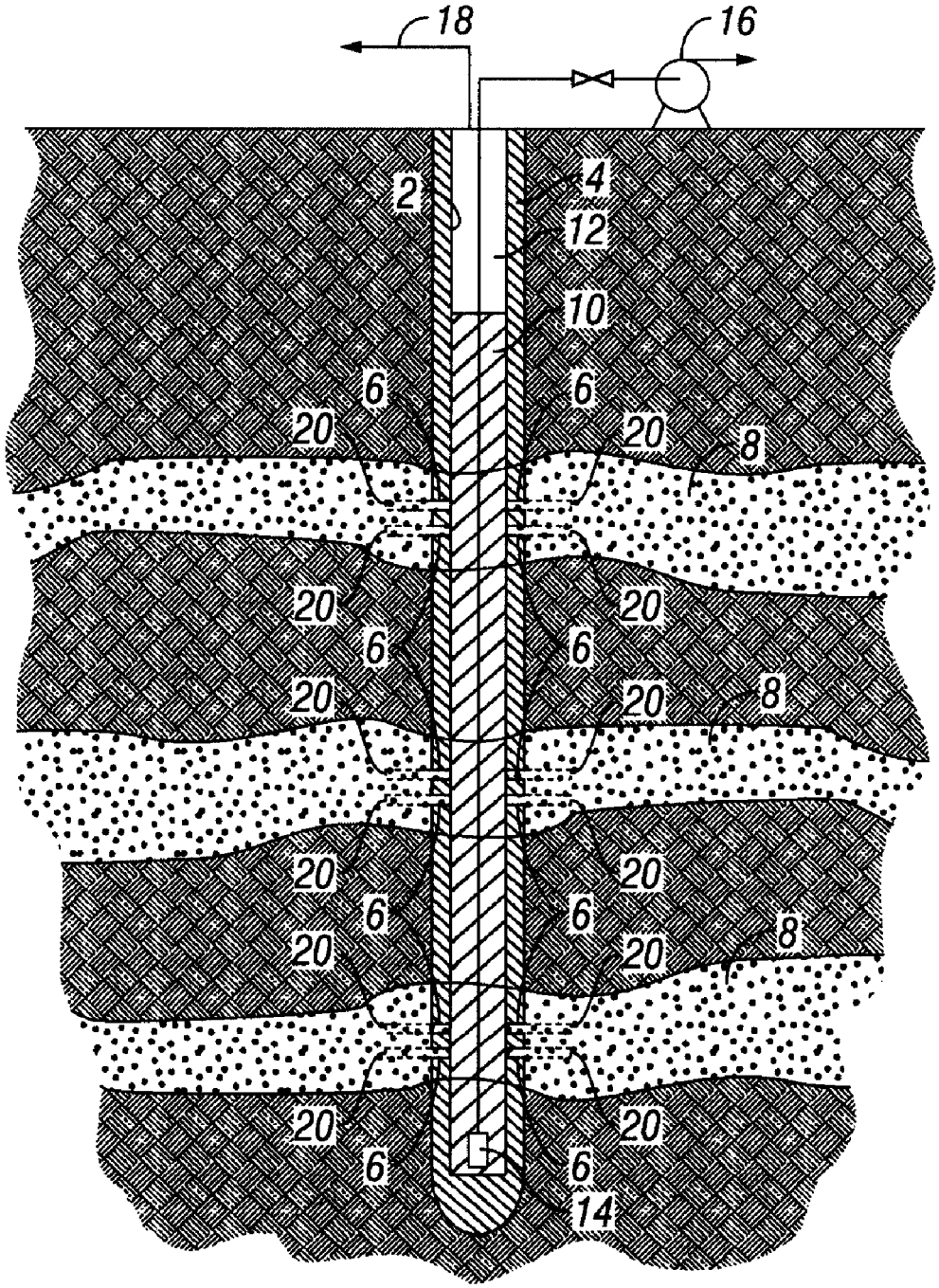
FIG. 1 (Prior Art)
FIG. 1 is a schematic cross-sectional view of a typical coal-bearing formation having a cased wellbore therein with perforations created by standard charges.

It is to be noted, however, that the appended drawings are not to scale and illustrate only typical embodiments of this invention, and are therefore not to be considered limiting of its scope, for the invention may admit to other equally effective embodiments.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible.

Since the mid-1980s, in the United States coalbed methane (CBM) has become an increasingly important unconventional source of fossil fuel. For many years CBM was primarily an underground coal-mine safety problem and a large body of literature exists on this subject. Over the last two decades there has been a rapid acceleration of interest in CBM as an unconventional fossil fuel. Coalbed methane is also referred to as coalbed gas by some. As much as 98% of the CBM is adsorbed in coal micropores, which generally have diameters less than 40 angstroms, rather than being in intergranular pores as in conventional gas reservoirs. Most of the water in the cleat system of coal must be removed before the CBM can be desorbed. Natural fractures in coal (cleats) are the principal conduits for the transfer of water and methane from coal reservoirs. Face and butt cleats are the primary and secondary cleat systems in coal, respectively, and these are a function of regional structure, coal rank, coal lithotype, bed thickness, and other factors. The methods of the present invention are most applicable to methane contained in coal-bearing formations due to the cleat systems therein, because they provide the ability to penetrate coal formations with explosive charges to form man-made fractures.

The methods of the present invention involve the introduction, into subsurface coal seams via drilled wellbores, of compositions that release and/or generate oxidizing materials in sufficient concentration and quantity to produce local, temporary oxidizing conditions sufficient to support rapid, local, temporary oxidation reactions. The effect is local because of the ability of the operation personnel to dictate where in the coal-bearing formation the composition is applied, and the effect is temporary because once the oxidant in the composition is expended, combustion stops. During combustion, the heat of combustion is transferred to the surrounding carbonaceous material in the coal seam, and if sufficient water is present, steam may form and expand into cleats and natural fractures, as well as into man-made fractures, further increasing the size of the cleats, natural fractures, and other fractures, particularly those near the wellbore. The intention of this reaction is to stimulate the production of natural gas from these coal seams by removing coal in key areas to improve the connectivity and flow paths from the coal seam to the wellbore.

In one method in accordance with the invention, denoted perforation enhancement, perforation fluid paths (sometimes referred to as tunnels) from a steel-cased wellbore or other wellbore to a coal seam, often initially made through shaped charges that fire and create holes through the casing and cement isolation sheath, into the coal formation, are enlarged by modifying the charges to include a composition sufficient to create the local, temporary oxidizing environments discussed herein. Alternatively, through the application of a co-perforation or post-perforation propellant treatment that produces an excess of free oxygen, the perforation size and penetration into the coal seam may be enhanced by removing additional coal from the perforation tunnels through rapid oxidation. By co-perforation is meant that the oxidizer is applied during perforating, for example by perforating through a previously installed pre-pack comprising an oxidizer.

In another method of the invention, denoted rapid oxidation etched hydraulic fracturing, a fracturing treatment fluid is injected into the coal seam at a higher rate than the coal cleat matrix can accept. This rapid injection produces a buildup in wellbore pressure until it is large enough to overcome compressive earth stresses and the coal's tensile strength. At this pressure the coal fails, allowing a crack (or fracture) to be formed. Continued injection increases the fracture's length and width. The method opens up cleats oriented in accordance with the stresses in the coal. A composition able to create local, temporary oxidizing conditions is added to the fracturing fluid to create a rapid oxidation reaction in the coal adjacent to the induced fractures. This rapid oxidation reaction will remove a portion of the coal and create a flow channel that extends deep into the formation and remains open when the well is placed back on production. Rapid oxidation etched hydraulic fracturing treatment can be applied as a stand alone stimulation treatment, or as a pre-treatment to conventional proppant fracturing to remove near wellbore tortuosity constrictions that often result in premature termination of a propped fracture treatment due to proppant bridging near the wellbore.

The basic coal combustion reaction may be represented by the following equation:

$$CH_{(H/C)_f}+O_2 \Leftrightarrow CO_2+CO+H_2O+\text{noncombustible ash}$$
(typically 5-12 percent)

The $(H/C)_f$ subscript is termed the equivalent hydrogen-to-oxygen ratio that varies from coal to coal. A typical coal composition and thermal values are provided in Table 1. The oxidizer used to create the local, temporary oxidizing environment will combust coal and a small amount of CBM, until the oxidizer is completely consumed, after which the local environments return to their reducing atmosphere status. Without being limited to any particular theory, the combined effects of combustion and expansion of the heated reaction gases results in enlargement of at least those natural fractures in the coal-bearing formation nearest the wellbore, or enlargement of the initial perforations in a perforation operation. The products of the combustion reactions will be produced out of the wellbore and processed by gas- and liquid-handling facilities, which are not considered part of the present invention. If the temperature of the wellbore is low enough, any water formed as a result of combustion will condense and be pumped out by pumps already in place for pumping produced water. Using the coal reaction stoichiometry above, and balanced reaction equations for combustion of methane, ethane, and other gases expected or measured to be present in the coal-bearing formation, one may calculate the theoretical amount of coal that might be removed using a given oxidizer. These calculations are considered well-known and need no further explanation herein.

TABLE 1

Typical Coal Composition and Thermal Values[1]

| Fuel | Formula (state) | Density kg/m$^3$ | Theoretical air/fuel ratio- | Higher Heating Value MJ/kg | Maximum adiabatic combustion temp. K. | Flash point & Autoignition temp. K. |
|---|---|---|---|---|---|---|
| Coal (dry, mean) | 85% C<br>5% H<br>5% O<br>5% M(s) | 1400 | 10 kg/kg | 28 | 2200 | 600 |

[1]From Harju, J. B., "Coal Combustion Chemistry," Pollution Engineering, May 1980 pp. 54-60.

Compositions useful in the invention comprise at least one oxidizer chemical. The oxidizer functions to react with (combust) carbonaceous material forming the walls of cleats, natural fractures, and man-made fractures in coal-bearing formations. Oxidizers may be organic, inorganic, or a combination thereof, and may be solid, liquid, gaseous, or any combination thereof, such as a slurry. The "oxidizer" need not consist only of the oxidizer or a single oxidizer chemical, or a single phase of any one oxidizer. For example, ozone may be present as a gas and dissolved in a liquid such as water. Not all oxidizer chemicals useful in the invention need have the same oxidation potential.

Examples of organic oxidizers include alkyltricarboranylalkyl perchlorates, such as methyltricarboranylmethyl perchlorate, as described in U.S. Pat. No. 3,986,906, incorporated by reference herein. As explained in this patent, methyltricarboranylmethyl perchlorate may be employed as a combination catalyst-oxidizer of a propellant composition additionally comprised of hydroxyl-terminated polybutadiene, a diisocyanate crosslinking agent, an interfacial bonding agent, ammonium perchlorate oxidizer, and a metal fuel. Propellant compositions of this nature have improved burning rates and improved mechanical properties. Since the methyltricarboranylmethyl perchlorate is a solid salt which contains three carboranyl functional groups and a perchlorate functional group per molecule, a gain in catalyst function and oxidizer function is achieved. The liquid carboranyl catalyst normally used can be replaced by the solid salt. Additional binder can be employed which permits the use of more oxidizer and metal fuel without a sacrifice of mechanical properties. The propellants are high solids loading propellants with ultrahigh burning rates.

Other useful oxidants may comprise hypochlorite, metallic salts of hypochlorous acid, hydrogen peroxide, ozone, oxygen and combinations thereof. Suitable oxidants may include chlorine dioxide, metallic salts of perchlorate, chlorate, persulfate, perborate, percarbonate, permanganate, nitrate and combinations thereof. Suitable oxidants may include peroxide, sodium hypochloride, water soluble salts of hypochlorous acid, perchlorate, chlorate, persulfate, perborate, percarbonate, permanganate, nitrate and combinations thereof.

Oxidants may be incorporated into charges, such as shaped charges, as long as precautions are taken to prevent unwanted detonation. Alternatively, the oxidant may be applied as a post-perforation treatment to previously formed perforations, or to cleats in the coal-bearing formation. Another alternative is to apply the oxidant during perforation through a pre-pack. Standard explosive charges known in the art may be used. In embodiments wherein the oxidizer is to be applied to a coal-bearing formation through the use of explosive charges in a perforating operation (either as part of a perforation charge or in a pre-pack), so-called insensitive high explosives may be used. In one known type of insensitive high explosive charge, a principal explosive, which is relatively insensitive to initiation of detonation, may be combined with a sensitizing explosive, which is relatively sensitive to initiation of detonation, a critical diameter additive, and a binder, as explained in U.S. Pat. No. 5,034,073, incorporated herein by reference. More specifically, the sensitizing explosive may comprises two mesh fractions of a sensitizing explosive, the combination giving the overall composition the desired insensitivity to accidental initiation of detonation. The term "mesh fraction" as used herein refers to separate portions of the sensitizing explosive with specific average particle sizes. The insensitivity of the compositions to accidental initiation of detonation is achieved by adjusting the ratio of average particle size of the first mesh fraction to second mesh fraction of the sensitizing explosive. Best results will generally be achieved with a particle size ratio ranging from about 50:1 to about 30:1, or from about 45:1 to about 35:1. The first mesh fraction of sensitizing explosive may have an average particle size ranging from about 140 to about 160 microns in diameter. The second mesh fraction of sensitizing explosive may have an average particle size ranging from about 1 to about 10 microns. The weight ratio of first mesh fraction to second mesh fraction of sensitizing explosive may range from about 1:1 to about 1:30, or from about 1:3 to about 1:10. The amount of oxidizer to be used depends on the application and the coal-bearing source of CBM, which can vary in composition, but when applied during a perforation operation, the oxidizer may be present in a weight ratio of oxidant to sensitizing explosive ranging from about 1:1 to about 1:10. Methane is usually the major component of CBM, but carbon dioxide, ethane, and higher hydrocarbon gases are important components of some coals. The term "critical diameter" as used in the '073 patent refers to the minimum diameter of a right cylinder of cast explosive at which detonation will sustain itself—i.e., achieve steady-state detonation. The term "critical diameter additive" refers to specific average particle size ingredients which function to lower the critical diameter of cast insensitive high explosives so that they may be deliberately initiated and used. To adjust the critical diameter of the composition using the critical diameter additive, an additive with average particle size ranging from about 10 to about 150 microns in diameter may be used, with best results being achieved with an average particle size ranging from about 25 to about 35 microns in diameter.

Within the above-defined groups, a number of specific examples may be mentioned. Examples of the principal (relatively insensitive) explosive are nitroguanidine, guanidine nitrate, ammonium picrate, 2,4-diamino-1,3,5-trinitrobenzene (DATB), potassium perchlorate, potassium nitrate, and lead nitrate. Of the sensitizing explosives, examples include: cyclo-1,3,5-trimethylene-2,4,6-trinitramine (RDX), cyclotetramethylenetetranitramine (HMX), 2,4,6-trinitrotoluene (TNT), pentaerythritoltetranitrate (PETN), and hydrazine. Critical diameter additives may be selected from amine nitrates and amino-nitrobenzenes. Amine nitrates found useful as critical diameter additives include ethylenediamine dinitrate (EDDN) and butylenediamine dinitrate (BDDN). Amino-nitro-benzenes found useful include 1,3,5-triamino-2,4,6-trinitrobenzene (TATB).

Examples of binder materials useful in the present invention include polybutadienes, both carboxy- and hydroxy-terminated, polyethylene glycol, polyethers, polyesters (particularly hydroxy-terminated), polyfluorocarbons, epoxides, and silicone rubbers (particularly two-part). Suitable binders include those that remain elastomeric in the cured state even at low temperatures such as, for example, down to −100 F. (−73 C.). The binders may be curable by any conventional means, including heat, radiation, and catalysis.

As an optional variation, metallic powders such as aluminum may be included in the composition to increase the blast pressure. For best results, the particle size will be 100 mesh or finer, preferably about 2 to about 100 microns. The powder will generally comprise from about 5 percent to about 35 percent by weight of the composition, the higher percentages being required for, among other uses, underwater explosives.

The relative proportions of these components in the composition are as follows, in weight percent of total explosive composition: the principal explosive ranges from about 30 percent to about 60 percent, the first mesh fraction of sensitizing explosive ranges from about 1 percent to about 10 percent; the second mesh fraction of sensitizing explosive ranges from about 10 percent to about 25 percent; and the critical diameter additive ranges from about 2 to about 20 percent. The remainder of the composition is binder or a binder composition, comprised of any liquid or mixture of liquids capable of curing to a solid form, optionally including further ingredients known for use with binders such as, for example, catalysts and stabilizers. The binder is included in sufficient amount to render the uncured composition pourable or pumpable so that it can be pour-cast or spotted in a wellbore by pumping. Accordingly, the amount of binder is from about 10 percent to about 20 percent by weight of the total explosive composition.

Standard charges useful in the invention may have an explosive output comparable to such explosives as 2,4,6-trinitrotoluene (TNT), TNT-based aluminized explosives, and Explosive D (ammonium picrate). The performance may be characterized by such parameters as detonation velocity, detonation pressure, and critical diameter. Critical diameter tests are performed using fiber optic leads and a dedicated computer. A square steel witness plate is placed on a support of wooden blocks. The cylindrically shaped sample is then secured to the center of the steel plate, and a detonator and booster firmly taped to the top of the sample. Fiber optic leads are embedded in the sample at known distances from the booster. The sample is fired and the detonation rate is read off a dedicated computer. A "go" results when the detonation rate is constant over the length of the sample. If the rate is fading with distance from the booster, or if the sample does not explode at all, it is considered a "no-go." In the preferred practice of the invention, the explosive components are selected to provide the composition with a critical diameter in confined tests of a maximum of about 4.0 inches (10.2 cm), more preferably a maximum of about 2.0 inches (5.08 cm); a detonation velocity of at least about 6.5 kilometers per second, more preferably at least about 7.0 kilometers per second; a detonation pressure of at least about 170 kilobars, more preferably at least about 200 kilobars. Sensitivity to initiation of detonation of an explosive may be determined and expressed in a wide variety of ways known to those skilled in the art. Most conveniently, this parameter is expressed in terms of the minimum amount or type of booster which when detonated by some means such as, for example, physical impact or electrical shock, will then cause detonation of the main charge explosive. For the principal and sensitizing explosives herein, the sensitivity of each to initiation may be expressed in terms of a lead azide booster. In particular, the principal explosive is characterized as one which is incapable of being initiated by a booster consisting solely of lead azide, but instead requires an additional component of higher explosive output, such as Tetryl™ (trinitrophenylmethylnitramine), to be included as a booster for initiation to occur. Likewise, the sensitizing explosive is characterized as one which is capable of being initiated by a booster consisting of lead azide alone. In preferred embodiments, when a booster consisting of a combination of lead azide and tetryl is used for the principal explosive, at least about 0.10 g of Tetryl™ will be required in the combination; and for the sensitizing explosive, less than about 0.5 g of lead azide will be required.

The oxidizer used to create the local, temporary oxidizing environments may be included in a separate compartment of a shaped charge, as further explained herein in reference to FIGS. 4 and 5. The oxidizer may also be contained in the hollow perforation gun, or as a material spotted in the wellbore or squeezed into the coal seam prior to the gun placement and firing. For example, an oxygen source (oxidizing material) may be pumped (or spotted) into the wellbore or into (or across) the coal seam in a first step, and then in a second step the perforating guns or the propellant gun may be used as an ignition source to promote or provide the combustion enhancement. The perforation or stimulation gun may be lowered into the wellbore after the oxidizer is placed, and fired off to create ignition in the coal seam. This method may be applied either in a new (unperforated) wellbore, or as a remedial stimulation treatment in which the oxidative material is squeezed into the coal seam prior to ignition. In a not yet perforated wellbore, the composition may be placed inside the casing adjacent the coal seam, or the composition may be pumped into the annulus between the casing and the coal and then cement may be pumped down the annulus and displace the composition into the bottom of the casing adjacent the coal seam.

Referring now to the figures, FIG. 1 is a schematic cross-sectional view of a typical coal-bearing formation having a cased wellbore 2 therein, with cement 4, and casing perforations 6 and coal-seam penetrations 20 created by standard charges. Water 10, usually referred to as produced water, is illustrated filling wellbore 2, and natural gas, usually referred to as coalbed methane or coalbed gas, collects near the top of wellbore 2, at 12. A produced water pump 14 may be present in the bottom of wellbore 2, along with an optional surface booster pump 16, for removing produced water 10. A conduit 18 is provided for routing coalbed methane 12 to gas processing facilities.

Figure 2:
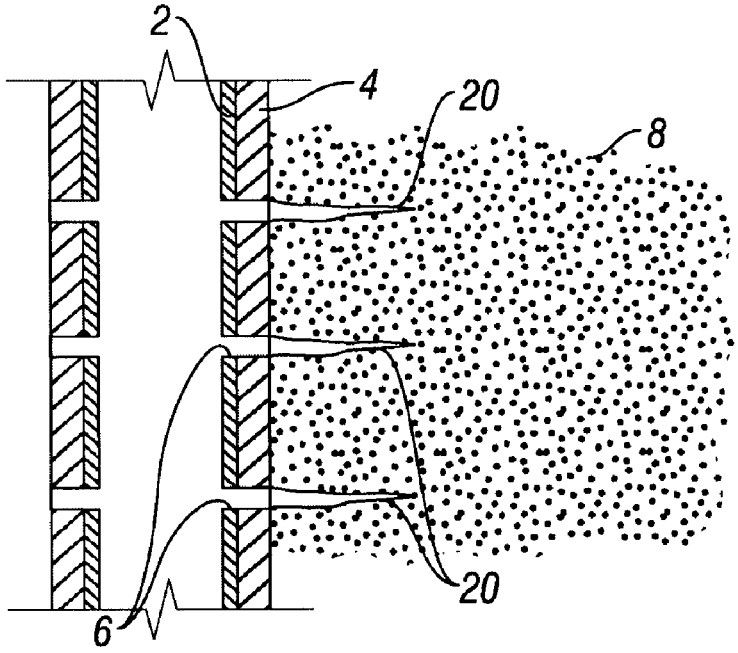
FIG. 2 (Prior Art)
FIG. 2 is a more detailed schematic partial cross-sectional view of a typical coal-bearing formation having a cased wellbore therein with perforations created by standard charges.

FIG. 2 is a more detailed schematic partial cross-sectional view of a typical coal-bearing formation having a cased wellbore 2 therein with perforations 6 created by standard charges. Identical numerals are used to denote the same features in the various figures. Illustrated in FIG.2 are typical penetrations 20 extending into coal seam 8. Coalbed methane and water collect in penetrations 20 and are forced by pressure in coal seam 8 into wellbore 2 for production.

Figure 3:
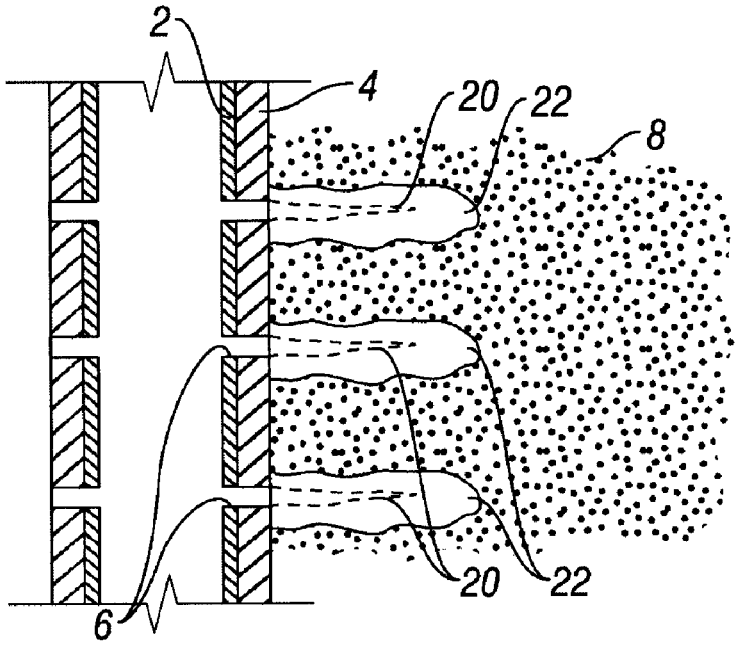
FIG. 3 is schematic partial cross-sectional view of the coal-bearing formation having a cased wellbore therein illustrated in FIG. 2 with enlarged perforations created in accordance with a method of the invention.

FIG. 3 is a schematic partial cross-sectional view of the coal-bearing formation having a cased wellbore 2 therein illustrated in FIG. 2 with enlarged penetrations 22 created in accordance with the first and second methods of the invention. The size of original penetrations 20 are illustrated with dotted lines. It is evident that flow paths are much greater in size in penetrations 22, which should lead to greater production of coalbed methane.

After a well has been drilled and casing has been cemented in the well, perforations are created to allow communication of fluids between reservoirs in the formation and the wellbore. Shaped charge perforating is commonly used, in which shaped charges are mounted in perforating guns that are conveyed into the well on a slickline, wireline, tubing, or another type of carrier. The perforating guns are then fired to create openings in the casing and to extend perforations as penetrations into the formation. As noted earlier, cased or uncased wells may include a pre-pack comprising an oxidizer composition, and perforation may proceed through the pre-pack. These techniques may be used separately or in conjunction with shaped charges that include an oxidizer in the charge itself. The methods may comprise suddenly decreasing pressure of the wellbore after the combusting step and prior to the injection of a fracturing fluid, as this is known to increase production of CBM.

Any type of perforating gun may be used. A first type, as an example, is a strip gun that includes a strip carrier on which capsule shaped charges may be mounted. The capsule shaped charges are contained in sealed capsules to protect the shaped charges from the well environment. Another type of gun is a sealed hollow carrier gun, which includes a hollow carrier in which non-capsule shaped charges may be mounted. The shaped charges may be mounted on a loading tube or a strip inside the hollow carrier. Thinned areas (referred to as recesses) may be formed in the wall of the hollow carrier housing to allow easier penetration by perforating jets from fired shaped charges. Another type of gun is a sealed hollow carrier shot-by-shot gun, which includes a plurality of hollow carrier gun segments in each of which one non-capsule shaped charge may be mounted.

Figure 4A:
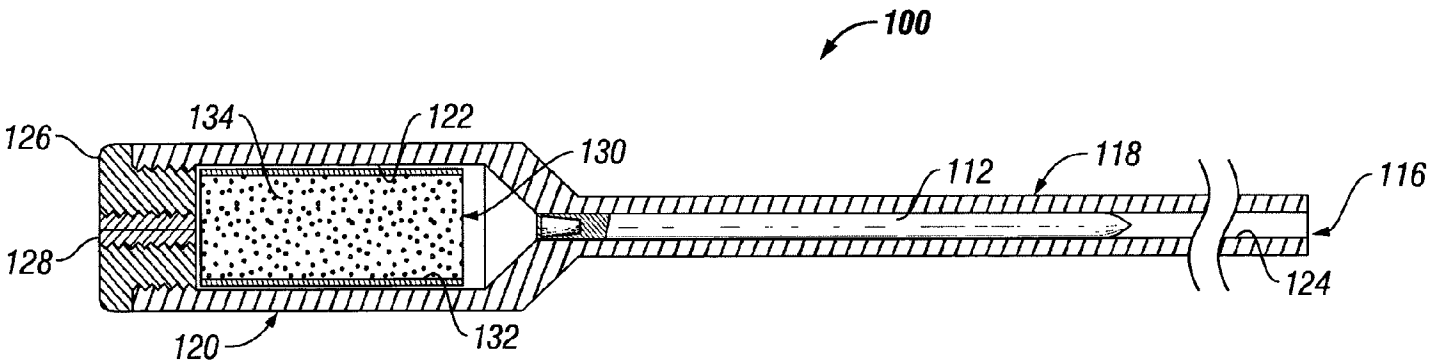
FIG. 4A and 4B are a schematic partial longitudinal cross-sectional views of a launcher and projectile, respectively, that may be useful in practicing one of the methods of the invention.
Figure 4B:
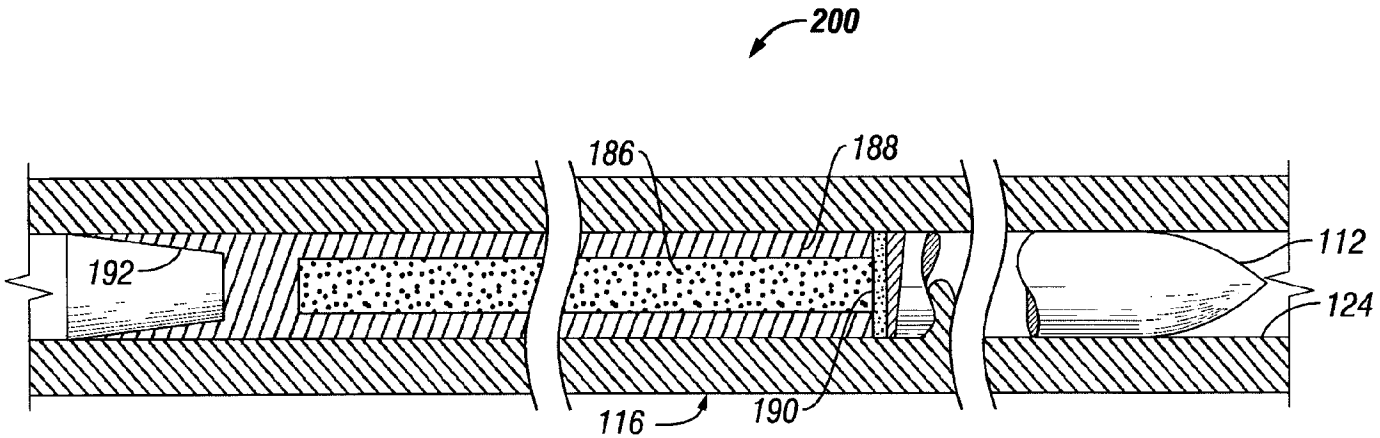

In FIG. 4A there is illustrated a longitudinal sectional view of a typical projectile propelling device or launcher 100 that may be used for accelerating a projectile 112 through wellbore casing and into a coal-bearing formation. Launcher 100 comprises, basically, a muzzle section 116, a barrel section 118 and a breech section 120. In the embodiment illustrated in FIG. 4A, breech section 120 comprises a propellant chamber 122 having a diameter larger than the bore 124 of launcher barrel 11 8. Access to chamber 122 is obtained by threaded breech plug 126 in which may be disposed an ignition plug 128. FIG. 4B is a longitudinal partial sectional view 200 of a typical projectile that may be used in the projectile propelling device of FIG. 4A. The dimensions of the devices illustrated in FIGS. 4A and 4B are not to scale and are somewhat exaggerated in order to illustrate how and where the oxidizer may be loaded and used in a shaped charge in practicing the first method of the invention. In FIG. 4B a smaller projectile 112 is positioned in front of a large hollow projectile 188 containing a composition comprising an oxidizer 186. Composition may be solid, liquid, gaseous, or any combination thereof, such as a slurry, or a composite of solid particles dispersed in a binder, such as a polymeric binder, or a gel. When a main propellant charge 134 (FIG. 4A) is activated, its gases propel both projectiles 112 and 186 through barrel section 118. When the assembly has reached a high velocity, a delay igniter 190 may by timed to cause activation of composition 186. The gas pressure drives the light, leading projectile 112 forward at higher acceleration rates while the following hollow projectile 188 continues to compress composition 186 gases, thus insuring an increased mean pressure for this second launch. This results in quite a high velocity for leading projectile 112 without an excessively high breech pressure. Ignition of composition comprising oxidizer 186 may be achieved by utilizing the hot gases from main propellant charge 134 in the breech in conjunction with a heat conducting bulkhead (not shown). A heat sensitive material such as potassium chlorate having a low ignition temperature may be disposed in contact with the heat conducting bulkhead and with composition 186. The mass and thickness of heat conducting bulkhead will determine the time delay for ignition of the heat sensitive material, and thus composition 186.

Figure 5A:
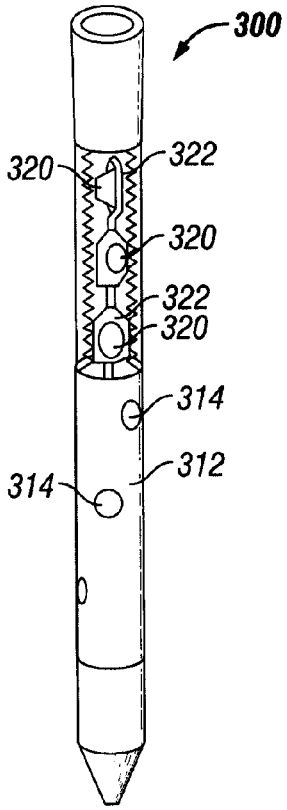
FIGS. 5A-5C are schematic perspective, cross-sectional and schematic side elevation views, respectively, of one explosive charge and projectile that may be used in practicing another method of the invention.

FIG. 5A illustrates schematically a perforating gun 300 that may be used in practicing the second method of the invention to perforate coal seams with shaped or other charges, followed by treatment with a composition comprising an oxidizer. Perforating gun 300 includes a hollow carrier 312. Hollow carrier 312 contains plural shaped charges 320 that are attached to a strip 322. Alternatively, shaped charges 320 may be attached to a loading tube inside hollow carrier 312. In the illustrated arrangement, shaped charges 320 are arranged in a phased pattern. Non-phased arrangements may also be provided. There are many varieties of shaped charges. Any type of shaped charge, modified as discussed in accordance with the invention, may be used.

Hollow carrier 312 has a housing that includes recesses 314 that are generally circular, as illustrated in FIG. 5A. Recesses 314 are designed to line up with corresponding shaped charges 320 so that a perforating jet exits through the recess to provide a low resistance path for the perforating jet. This enhances performance of the jet to create openings in the surrounding casing as well as to extend perforations into the formation behind the casing.

Figure 5B:
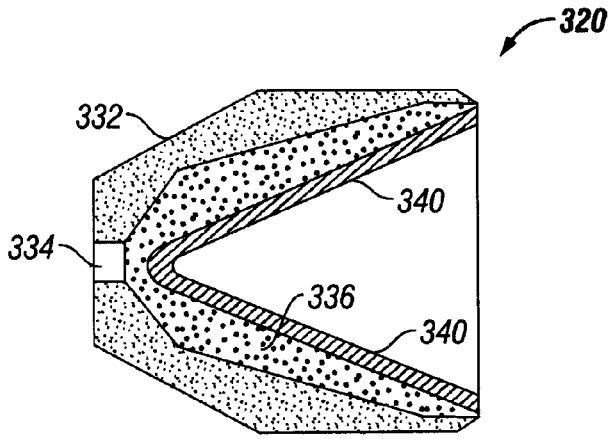
Figure 5C:
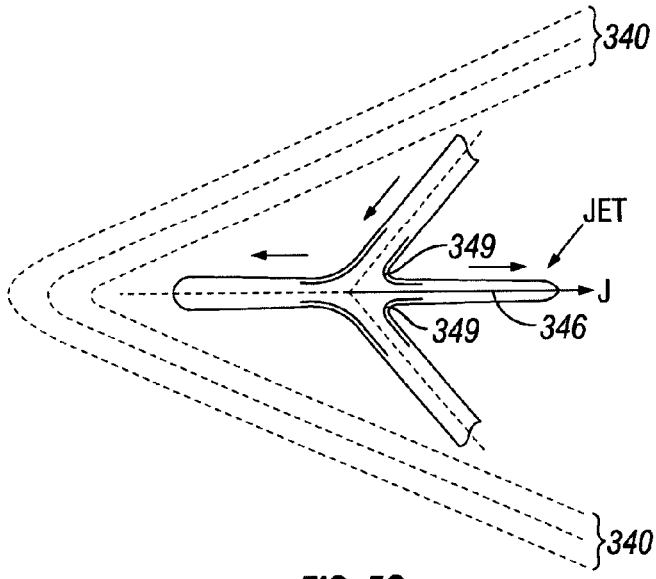

Referring to FIGS. 5B-5C, a generally conical shaped charge 320 includes an outer case 332 that acts as a containment vessel designed to hold the detonation force of the detonating explosive long enough for a perforating jet to form. The generally conical shaped charge 320 is a deep penetrator charge that provides relatively deep penetration. Another type of shaped charge includes substantially non-conical shaped charges (such as pseudo-hemispherical, parabolic, or tulip-shaped charges). The substantially non-conical shaped charges are big hole charges that are designed to create large entrance holes in casing.

The conical shaped charge 320 illustrated in FIG. 5B includes a main explosive 336, such as those discussed herein above, that is contained inside an outer case 332 and is sandwiched between the inner wall of outer case 332 and the outer surface of a liner 340 that has generally a conical shape. The oxidizer capable of creating the local, temporary oxidizing atmospheres in perforations or fractures may be included in the shaped charge in a separate compartment so that it is carried along with the jet, or delivered to the perforations after the initial perforation. A primer 334 provides the detonating link between a detonating cord (not shown) and main explosive 336. Primer 334 is initiated by the detonating cord, which in turn initiates detonation of main explosive 336 to create a detonation wave that sweeps through the shaped charge 320. As illustrated in FIG. 5C, upon detonation, liner 340 (original liner 340 represented by dotted lines 340) collapses under the detonation force of main explosive 36. Material from collapsed liner 340 flows along streams (such as those indicated as 349 ) to form a perforating jet 346 along a J axis.

The tip of the perforating jet travels at speeds of approximately 25,000 feet per second (about 760 meters per second) and produces impact pressures in the millions of pounds per square inch (thousands of megaPascals). The tip portion is the first to penetrate recess 314 in the housing of the hollow gun carrier 312. The perforating jet tip then penetrates the wellbore fluid immediately inside the geometry of recess 314. At the velocity and impact pressures generated by the jet tip, the wellbore fluid is compressed out and away from the tip of the jet. However, due to confinement of the wellbore fluid by the substantially perpendicular side surfaces of the recess 314, the expansion, compression, and movement of the wellbore fluid is limited and the wellbore fluid may quickly be reflected back upon the jet at a later portion of the jet (behind the tip). As the perforating jet passes through recess 314, a compression wave front is created by the perforating jet in the fluid that is located in the recess. When the compression wave impacts side surfaces of recess 314, a large portion of the compression wave is reflected back towards the perforating jet, which carries the wellbore fluid back to the jet.

In forming the recesses, the recesses are made relatively deep to reduce the resistance path for a perforating jet, but not so deep that the carrier housing is unable to support the external wellbore pressures experienced by the gun carrier. The size of the recesses is also optimized to ensure that jets pass through the recesses and not through the carrier housing around the recesses. However, the sizes of the recesses are limited to enhance the structural integrity of the carrier housing in withstanding external wellbore pressures and internal forces created by detonation of the shaped charges.

Figure 5D:
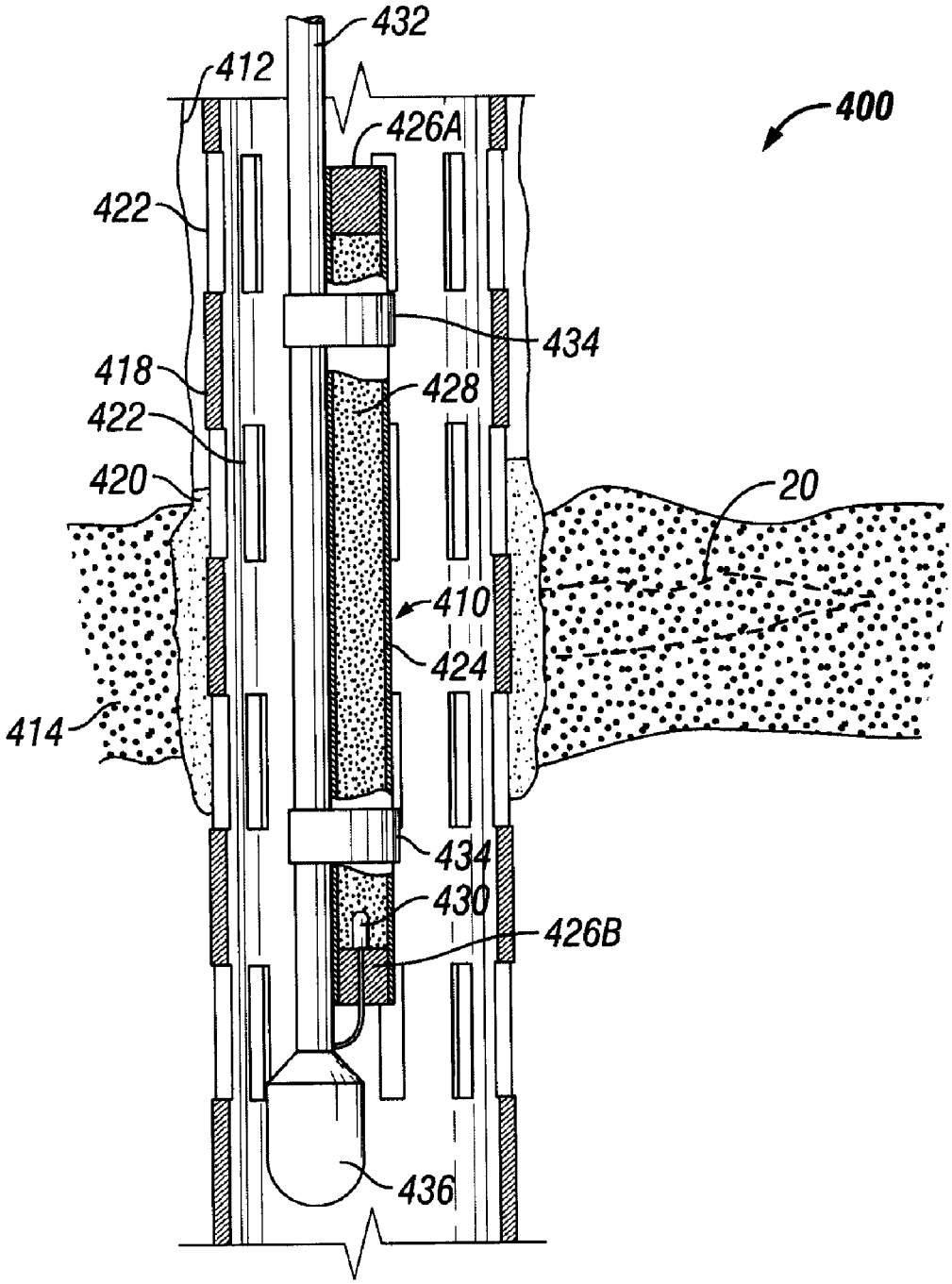
FIG. 5D illustrates in partial cross section a simplified version of a charge of a composition comprising an oxidizer for use in practicing one method of the invention.

Following perforation of a coal-bearing formation using a device such as explained in reference to FIGS. 5A-5C, a composition comprising an oxidizer is applied to the perforations, which may be carried out using any known apparatus such as that illustrated in FIG. 5D. FIG. 5D illustrates in partial cross section a simplified version 400 of a charge 410 of a composition comprising an oxidizer for use in practicing the second method of the invention and comprises, basically, a housing 424 which is sealed at each end by fluid seals 426*a* and 426*b* and which contains a composition 428 comprising an oxidizer. An igniter 430 is disposed proximate the bottom end of charge 410 which is in turn connected to an electrical ignition system (not shown) through electrical conductors and support cable 432. Charge 410 is attached to cable 432 by means of fasteners 434. A cable-head weight 436 may be attached at the bottom of cable 432 to aid in both centering charge 410 in, and to facilitate its descent down, the wellbore. Typically, housing 424 may vary in outside diameter from less than an inch to 3 inches (less than 2.54 cm to 7.62 cm). The rigidity of the system permits lowering charge 410 undisturbed to the zone to be stimulated where it is activated by the application of electric current to the igniter 430 which in turn initiates combustion of the composition 428 comprising an oxidizer at one end. As the flame front traverses the material, an increase in pressure is registered against the walls of housing 424 which may be made from aluminum tubing or a rigid, plastic or elastomeric material. If rigid, longitudinal bursting occurs when the internal pressure reaches a given level. With a plastic material, expansion may first occur, followed by failure at the thinnest section. With an elastomeric material of sufficient thickness, exceptional swelling under the internal gas pressure may result without actually rupturing the walls of housing 424. In either case, fluids present in well bore 412 surrounding the system are rapidly displaced outward through perforations 422 in the well casing, and oxidizer is delivered into perforations 20. Any obstructions, such as sand, tar and debris 420, in casing perforations 422 are swept radially into perforations 20 or into surrounding coal seam 414. Fasteners 434 may comprise metallic clasps, plastic or elastomeric materials, which are strained during the gas expansion but can return to their original position after housing 424 has either ruptured or has returned to its original size after gas escape through weak spots or through the ends after ejection of the fluid seals 426. The purpose of the fastening means is to secure the system during its journey from the surface to production zone 414 and to retain all or the majority of housing 424 during and after gas generation. This is particularly important in wells that are provided with a pumping unit where debris left floating in the well fluid can seriously interfere with the operation of ball and seat valves.

Alternative methods of the invention depend not on increasing the size of perforations, but on increasing the size of cleats and fractures in coal seams. Fracturing, or fracing, is a stimulation treatment routinely performed on oil and gas wells in low-permeability reservoirs. Specially engineered fluids are pumped at high pressure and rate into the reservoir interval to be treated, causing fractures to open. The wings of the fracture extend away from the wellbore in opposing directions according to the natural stresses within the formation. Proppant, such as grains of sand of a particular size, is mixed with the treatment fluid to keep the fracture open when the treatment is complete. Hydraulic fracturing creates high-conductivity communication with a large area of formation and bypasses any damage that may exist in the near-wellbore area. Ball sealers may be used, small spheres designed to seal perforations that are accepting the most fluid, thereby diverting reservoir treatments to other portions of the target zone. Ball sealers are incorporated into the treatment fluid and pumped with it. The effectiveness of this type of mechanical diversion to keep the balls in place is strongly dependent on the differential pressure across the perforation and the geometry of the perforation itself.

Figure 6:
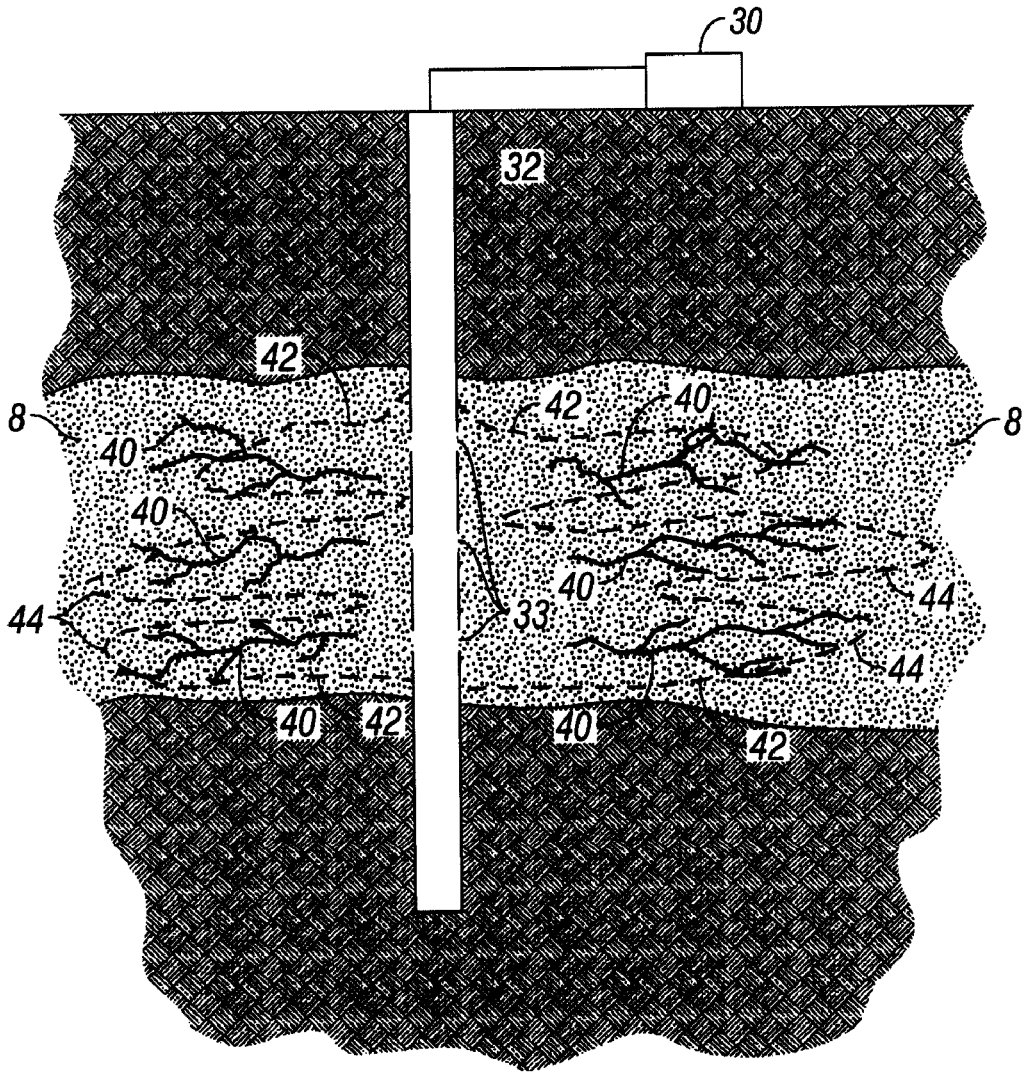
FIG. 6 is a schematic partial cross-sectional view of an uncased wellbore in a typical coal-bearing formation showing both original size fractures and an example of how the fractures may be enlarged using methods of the invention.

FIG. 6 is a schematic partial cross-sectional view of a typical coal-bearing formation having an uncased wellbore 32 therein and showing both original size fractures 40 and an example of how the fractures may be enlarged using methods of the invention. A high pressure frac pump 30 may be used to pump a composition able to create local, temporary oxidizing atmospheres in the vicinity of original fractures 40 though a series of holes 33 in wellbore 32, leading to combustion and subsequent increase in size of the fractures, as illustrated at 42 and 44. This proppantless fracturing may be followed by a proppant fracturing stage. In this method of the invention, denoted "rapid oxidation etched hydraulic fracturing", a fracturing treatment fluid is injected into the coal seam at a higher rate than the coal cleat matrix can accept. This rapid injection produces a buildup in wellbore pressure until it is large enough to overcome compressive earth stresses and the coal's tensile strength. At this pressure the coal fails, allowing a crack (or fracture) to be formed. Continued injection increases the fracture's length and width. A composition able to create local, temporary oxidizing conditions may be added to the fracturing fluid to create a rapid oxidation reaction in the coal adjacent to the induced fractures. Alternatively, the composition able to create local, temporary oxidation environments may be applied after a standard fracturing step. The rapid oxidation reaction will remove a portion of the coal and create a flow channel that extends deep into the formation and remains open when the well is placed back on production. Rapid oxidation etched hydraulic fracturing treatment can be applied as a stand alone stimulation treatment, or as a pretreatment to conventional proppant fracturing to remove near wellbore tortuosity constriction that often results in premature termination of a propped fracture treatment due to proppant bridging near the wellbore.

Initiation of combustion in coal seam 8 may performed using any one or more of a variety of readily known methods, including, but not limited to, use of electric heaters, gas heaters, preheating a fuel and an oxidizer (either the same as or different from the oxidizer used to create the local, temporary oxidizing zones) so they auto-combust, using an electric wire and power source to create a spark, and the like. In some embodiments, an ignition source may be disposed proximate a location in the wellbore, such as at or near a hole 33, where composition comprising an oxidant is being injected into coal seam 8. The ignition source may be an electronically controlled ignition source, or controlled by a computer. The ignition source may be coupled to an ignition source lead-in wire, and the lead-in wire may be further coupled to a power source for the ignition source. An ignition source may be used to initiate oxidation of CBM exiting a perforation 20. After initiation the ignition source may be turned down and/or off.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims.

What is claimed is:

1. A method comprising:

(a) providing a wellbore able to access a coal-bearing formation containing methane gas;

(b) providing a perforation charge comprising a standard charge portion and a non-aluminum-metal-containing composition able to produce localized temporary oxidizing environments in perforations;

(c) perforating the coal-bearing formation through the wellbore with the perforation charge to form initial perforations defined by carbonaceous material, the initial perforations having localized temporary oxidizing environments therein; and (d) initiating combustion of the carbonaceous material using the oxidizing environments, thus enlarging the initial perforations; and (e) producing the methane gas contained in the formation from the wellbore subsequent to initiating combustion of the carbonaceous material.

2. The method of claim 1 wherein the composition is selected from gases, liquids, solids, and any combination thereof.

3. The method of claim 1 wherein the composition comprises oxidants selected from hypochlorite, hypochloride, hypochlorous acid, hydrogen peroxide, ozone, oxygen, chlorine dioxide, perchlorate, chlorate, persulfate, perborate, percarbonate, permanganate, nitrate, salts of any of these, combinations any of these, and combinations of any salt of these with any of these.

4. The method of claim 1 wherein enlarging the initial perforations comprises increasing any one or more dimension of the initial perforations.

5. The method of claim 1 wherein the wellbore is selected from cased, cased and cemented, and open hole wellbores.

6. The method of claim 1 wherein the combusting creates flow channels of volume larger than the initial perforations.

7. The method of claim 6 wherein the flow channels extend deeper into the coal-bearing formation than the initial perforations.

8. The method of claim 1 comprising injecting a fracturing fluid after the combusting step, the fracturing fluid selected from fluids comprising a proppant and fluids not comprising a proppant.

9. The method of claim 8 comprising suddenly decreasing pressure of the wellbore after the combusting step and prior to the injection of a fracturing fluid.

10. The method of claim 1 comprising removing or bypassing a damaged region of the coal-bearing formation adjacent to the wellbore.

11. A method comprising:

(a) providing a wellbore able to access a coal-bearing formation containing methane gas;

(b) perforating the coal-bearing formation with a standard perforation charge, thereby creating perforations; and (c) treating the perforations with a non-aluminum-metal-containing composition creating temporary local oxidizing environments comprising an oxidant in the perforations, and initiating combustion of carbonaceous material using the oxidizing environments, thus enlarging the perforations; and (d) producing the methane gas contained in the formation from the wellbore subsequent to treating the perforations.

12. The method of claim 11 wherein the composition is selected from gases, liquids, solids, and any combination thereof.

13. The method of claim 11 wherein the composition comprises oxidants selected from hypochiorite, hypochioride, hypochiorous acid, hydrogen peroxide, ozone, oxygen, chlorine dioxide, perchiorate, chlorate, persulfate, perborate, percarbonate, permanganate, nitrate, salts of any of these, combinations any of these, and combinations of any salt of these with any of these.

14. The method of claim 11 comprising removing or bypassing a damaged region of the coal-bearing formation adjacent to the wellbore.

15. The method of claim 11 wherein the wellbore is selected from cased, cased and cemented, and open hole wellbores.

16. The method of claim 11 wherein the combusting creates flow channels of volume larger than the perforations.

17. The method of claim 11 wherein the perforating and treating are performed substantially simultaneously by perforating through a pre-pack comprising the composition.

18. A method comprising:

(a) contacting, through a wellbore, surfaces of cleats and fractures of a coal-bearing formation containing methane gas with a non-aluminum-metal-containing composition comprising, or that produces upon contact with the surfaces, localized temporary oxidizing environments in the fractures; and (b) combusting carbonaceous material in the oxidizing environments under conditions sufficient to oxidize some of the carbonaceous material to enlarge the fractures; and (c) producing the methane gas contained in the formation from the wellbore subsequent to combusting the carbonaceous material.

19. The method of claim 18 wherein the composition comprises oxidants selected from hypochlorite, hypochioride, hypochlorous acid, hydrogen peroxide, ozone, oxygen, chlorine dioxide, pereblorate, chlorate, persulfate, perborate, percarbonate, permanganate, nitrate, salts of any of these, combinations any of these, and combinations of any salt of these with any of these.

20. The method of claim 18 wherein the wellbore is selected from cased, cased and cemented, and open hole wellbores.

21. The method of claim 18 wherein the combusting carbonaceous material comprises removing or bypassing a damaged region of the coal-bearing formation adjacent to the wellbore.

22. A method comprising:

(a) providing a wellbore able to access a coal-bearing formation containing methane gas;

(b) injecting into the wellbore a fluid composition creating temporary local oxidizing environments comprising an oxidant; and (c) perforating the coal-bearing formation with a standard perforation charge, thereby creating perforations and initiating combustion of carbonaceous material using the oxidizing environments; and (d) producing the methane gas contained in the formation from the wellbore subsequent to initiating combustion of the carbonaceous material.

23. The method of claim 22 wherein the wellbore is selected from cased, cased and cemented, and open hole wellbores.

24. The method of claim 22 wherein the wellbore is cased and the composition is injected into the casing.

25. The method of claim 22 wherein the wellbore is cased and cemented and the composition is injected behind the casing before the cement.

* * * * *